United States Patent [19]

Eaton-Williams

[11] Patent Number: 4,952,779

[45] Date of Patent: Aug. 28, 1990

[54] HUMIDIFIER CONTROL MEANS

[76] Inventor: Raymond H. Eaton-Williams, "Heathers", Farnaby Drive, Sevenoaks, Kent, England, TN13 2LQ

[21] Appl. No.: 325,722

[22] Filed: Mar. 20, 1989

[30] Foreign Application Priority Data

Mar. 18, 1988 [GB] United Kingdom ..... 8806486

[51] Int. Cl.[5] ..... H05B 3/60

[52] U.S. Cl. ..... 219/295

[58] Field of Search ..... 219/295, 326, 324, 316, 219/323, 285, 286

[56] References Cited

U.S. PATENT DOCUMENTS

| | | | |
|---|---|---|---|
| 3,937,920 | 2/1976 | Gundacker et al. | 219/286 |
| 4,347,430 | 8/1982 | Howard-Leicester | 219/295 |
| 4,382,173 | 5/1983 | Howard-Leicester | 219/295 |
| 4,418,269 | 11/1983 | Eaton-Williams | 219/295 |
| 4,430,555 | 2/1984 | Stokes | 219/295 |
| 4,675,505 | 6/1987 | Fischer | 219/295 |
| 4,841,122 | 6/1989 | Marton | 219/295 |

*Primary Examiner*—Roy N. Envall, Jr.
*Attorney, Agent, or Firm*—Berman, Aisenberg & Platt

[57] ABSTRACT

An electrode water boiler, preferably for the humidification of air, comprising a boiler having two or more electrodes connected to an electrical supply source between which current flows through the water in order to heat the water, the boiler also having a steam outlet, a valve for feeding water into the boiler, a valve for discharging water from the boiler, a sensor for sensing the current in one or more electrodes, and control means responsive to the sensed electrode current arranged to initiate the feed water valve when the electrode current is below a predetermined lower value and to initiate the water discharge valve after the electrode current has risen above a predetermined higher value and, following the initiation of the feed water valve and the electrode current subsequently rising to a predetermined intermediate value between the said lower and higher values, to effect the introduction, into the boiler, of a fixed measured quantity of feed water.

11 Claims, 2 Drawing Sheets

OPERATION OF BOILER CYLINDER

HUMIDIFIER CONTROL MEANS

Figure 1:
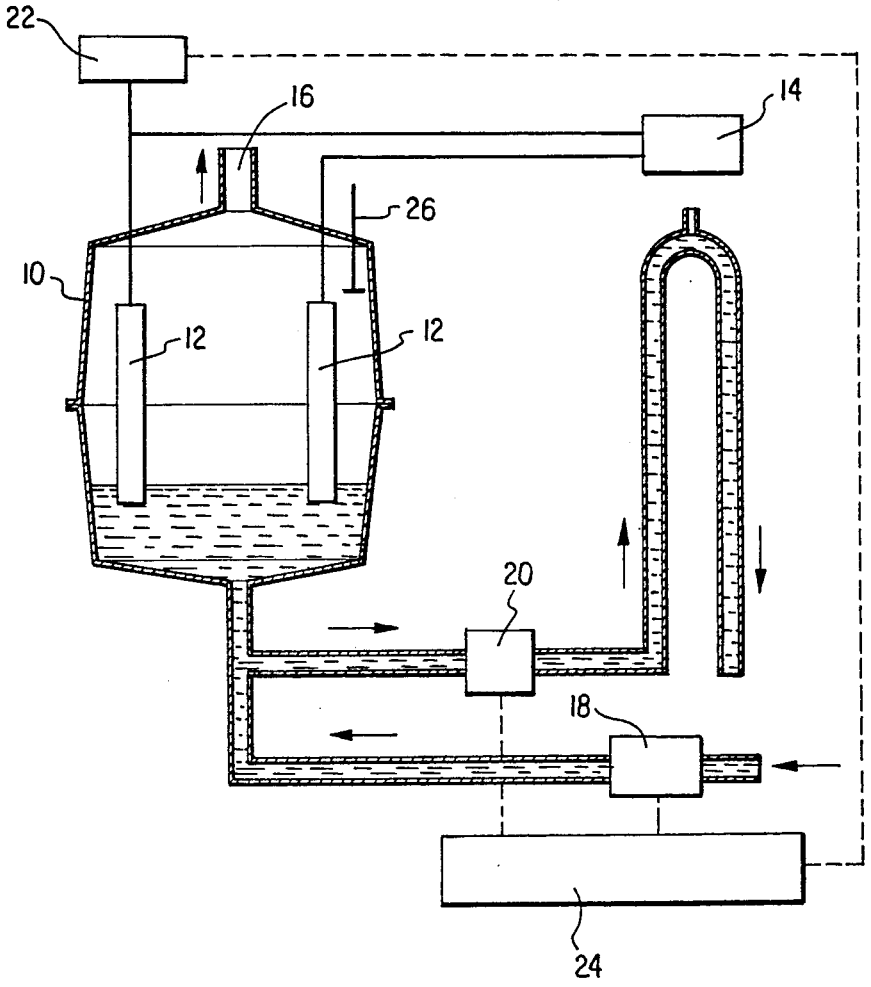

This invention relates to humidifier control means, especially for the control of electrode boiler humidifiers which are principally but not exclusively for use at or near ambient atmospheric pressure for the humidification of air and which comprise a boiler having two or more electrodes adapted to be connected to an electrical supply and between which current flows through the water during operation of the boiler in order to heat the water, there being a steam outlet from the boiler, means for feeding water into the boiler, means for discharging water from the boiler, means for sensing the current in one or more electrodes, and control means responsive to the sensed electrode current arranged to initiate the feed water means when the electrode current is below a predetermined lower value and to initiate the water discharge means after the electrode current has risen above a predetermined higher value.

In electrode boiler humidifiers for adding water vapour to the air in air conditioning, it is usual for current measuring means to be provided in order to determine the conductivity of the water and to control the supply of fresh feed water to the boiler and the discharge of water from the boiler. The reason for the discharge of water from the boiler is that it prevents the mineral content—and hence the conductivity—of the water in the boiler rising to an excessively high level. Better still, it can be used to control the conductivity of the water in the boiler to a desired level. This is necessary with most types of water as otherwise, if no discharge occurs, the mineral content of the water and hence its conductivity will continue to rise in an uncontrolled manner to the detriment of satisfactory operation of the boiler. The discharge therefore serves to remove mineral-enriched water from the boiler and to allow this to be replaced by fresh feed water of a lower mineral content, thereby reducing the conductivity of the water in the boiler.

It will be appreciated that the magnitude of the electrode current which flows in an electrode boiler depends upon a number of factors. These are (a) the electrode area exposed to the water; (b) the surface conductivity of the electrodes, taking into account the build-up of scale which will occur; (c) the conductivity of the water; (d) the conductivity of the water path between the electrodes; and (e) the voltage between the electrodes. Because of this dependence of the electrode current on several different factors, different methods of operation are to be found in commercially-available electrode boilers.

Thus, in the boiler control system described in GB-B-1,418,994, the voltage is constant and the electrode surface area exposed to the water is substantially constant, the system being normally operated with the electrodes fully immersed. The conductivity of the path between the electrodes is made deliberately high, usually by fitting barriers, to compensate for the large surface area of electrode which is continuously in contact with the water. When a new boiler commences operation, the electrodes are not scaled and, therefore, the surface conductivity of the electrodes is high. In order to allow the desired current to flow, the conductivity of the water between the electrodes is controlled at a relatively low level. After a period of use, the electrodes become scaled to some extent and,- therefore, the surface conductivity reduces. The control system of GB-B-1,418,994 then allows the conductivity of the water between the electrodes to rise automatically so that the resulting electrode current remains substantially unchanged. After a long period of use, the electrodes become more scaled and the surface conductivity of the electrodes becomes lower still. To compensate for this, the conductivity of the water between the electrodes is allowed to rise to increasingly higher levels.

Although such a system is fully viable and has proved its worth commercially, it has the disadvantage that, as the system normally operates with the electrodes fully immersed, any foam resulting from the presence of undesired foaming substances in the fresh feed water will be confined in a very limited space above the water level. This can cause the water level to be artificially lowered as a result of spurious sensing by the level sense electrode forming part of the control system, and/or foam may be discharged into the steam outlet pipe. Except when used on water of very low initial conductivity or when used at low voltage, it is usually necessary to provide the boiler with barriers to limit the conductivity path between the electrodes, and this brings about considerable additional complexity and extra cost. When such a boiler is fed with very high conductivity feed water, the operating current will be reached before the electrodes are fully immersed and, under these conditions, it will operate in the mode described in GB-B-1,381,113. This has the advantage of enabling the boiler to operate satisfactorily over a very wide range of input water conductivities without any adjustment. But, when operating in this mode, the thermal efficiency is low as a discharge occurs on every feed/boil cycle.

A different form of boiler control is described in DE-OS-34 05 212. Here, the operating cycle is designed to maintain the water conductivity in the boiler substantially constant but at a level considerably higher than the highest expected water conductivity of the input water. The voltage between the electrodes is constant, the system operates with the electrodes only partially immersed, and the conductivity path between the electrodes is constant. The variable factor is the electrode conductivity resulting from the combined effect of the amount of area exposed to the water and the integrated electrode surface conductivity over the immersed height of each electrode. Generally, the immersed bottom part of each electrode is heavily scaled. The overall parameters of the system are set such that, in normal operation, the effective immersed height at any time is of the order of 5 cm. During the lifetime of the boiler, this effective 5 cm height of electrode climbs up from the bottom of the electrode to the top as the electrodes become scaled.

A disadvantage of this form of control as described in the Specification is that capacity variation is generally achieved by altering the immersed height of the electrodes. In order, therefore, to provide a ten-to-one range of capacity (i.e., 10%–100%) it is necessary for the boiler to be able to operate over a ten-to-one ratio of immersed electrode height. Even with a 5 cm height representing 100% capacity, it will be seen that, to operate at 10% capacity, the immersed height will then only be 5 mm (with a clean boiler). This is a very small height on which to measure the small differences of height which will cause the current changes from, say, 100% current to 90% current, to operate the valves with adequate control stability. As the immersed height of electrode for 100% capacity is relatively large, it is still necessary, for most waters, to provide a restricted conductivity path between the electrodes in order to avoid the operating current being achieved at a lower immersed height than that desired. As a result, the boilers nearly always need to be fitted with barriers with their additional complexity and extra expense already mentioned above. As this system depends for its operation on maintaining a substantially constant (and relatively high) conductivity of the water in the boiler, it cannot afford to lose concentrated water by allowing discharge of the latter to take place in order to provide a reduction of capacity. For example, a reduction of capacity from 100% to 10% would typically require a lowering of the water level by 4.5 cm, and even one such cycle would substantially reduce the retained conductivity. As a result, in order to provide a lowering of output, the water is allowed to boil away rather than be discharged. This, however, often provides an unacceptably slow response to the control signal. Because of this the controller may cycle to the end of its proportional band, switching the control unit off altogether and, in effect, causing the system to revert to an on/off control rather than a proportional control. Conversely, a control demand for a large rise in output will result in a substantial quantity of cold water being introduced into the boiler, which water must first be raised to boiling temperature before it can evaporate. This also causes a response delay.

Yet another form of boiler control is shown in EP-A-02 45 023. In this case modulation over the full range from 10% to 100% is achieved by pulse width modulation of the electrode power. This is achieved at constant water level and constant electrode immersion height, and modulation over the full range is effected without either removing water from the boiler or adding water to the boiler.

It follows, therefore, that if an operating cycle system could be devised in which the variable element was the combined electrode conductivity relating to the area of electrode immersed and the degree of scaling on the immersed part and utilizing a capacity control by pulse width modulation of the electrode power as in EP-A-02 45 023, then the other parameters of the system could be so set that the effective height of electrode immersion required could be relatively small—for example, 1 to 2 cm.

The present invention has been devised with this consideration in mind, and according to the invention the control means of a humidifier as defined in the opening paragraph of the Specification are characterized by the property that, following the initiation of the feed water means and the electrode current subsequently rising to a predetermined intermediate value between the said lower and higher values, the control means effect the introduction, into the boiler, of a fixed measured quantity of feed water.

Preferably the water discharge means remain activated until the electrode current has fallen to a predetermined value lower than the said higher value. Additionally or alternatively, the water discharge means can remain activated additionally for a predetermined period of time. If the water discharge means are initiated during a feed water period, then the water discharge means can remain activated until the end of the feed period, or they can remain activated for a further period of time following the completion of the introduction into the boiler of the fixed quantity of feed water. Preferably the length of the additional period of activation of the discharge means is a function of the point during the feed period at which the water discharge means was initiated. The feed water means can be additionally activated during the additional activation period of the water discharge means.

In one form of electrode boiler in accordance with the invention, the introduction of the fixed measured quantity of feed water is achieved by discharging into the boiler the complete contents of a container of predetermined volume. Alternatively, the introduction of the fixed measured quantity of feed water can be achieved by passing the feed water through a constant flow rate device for a predetermined period of time.

For reasons of safety, provision can be made for the electrical supply to the electrodes to be disconnected during the period(s) when the water discharge means are activated.

The output of the boiler may be varied either by manual adjustment or as a result of the effect of automatic control signals. One way of varying the output would be to change the electrode current levels at which the control switching operations take place. The preset time constants of the control means can be varied in relation to the current levels at which the control switching operations take place. In particular, the output may be varied by pulse width modulation of the power supplied to the electrodes.

The practical benefits of this form of control are numerous. Thus, the boiler can operate with a relatively high water conductivity, thereby providing efficient thermal operation, while there is no need to restrict the path between the electrodes to lower the conductivity of this path. This means that simple non-barrier boiler cylinders with simple electrode structures can be used.

Another advantage is that the long start-up time associated with the systems described in GB-B-1,418,994 and DE-OS-34 05 212 when they are fed with a low-conductivity feed water (which means a long wait until the water in the boiler is suitably concentrated) is eliminated or substantially reduced. This is because, on the initial fill with low-conductivity feed water, the electrodes can be immersed to, say, five to seven times the required normal operating height, thereby providing an initial current of the same order as the operating current, with this situation continuing throughout the concentrating period.

The operating cycle control system of the present invention will arrange that fresh water is fed to the boiler cylinder when the output has fallen only a relatively small amount below the average output level. This control will most conveniently operate by sensing the electrode current in one of the electrodes. If the average output level is given by an electrode current of 100%, then a satisfactory feed arrangement will be for the feed valve to open when the current has fallen to 95% and, following the electrode current rising to a marginally higher value, say, 97%, to commence the introduction into the boiler of the fixed measured quantity of feed water, after which the feed valve would close.

Figure 2:
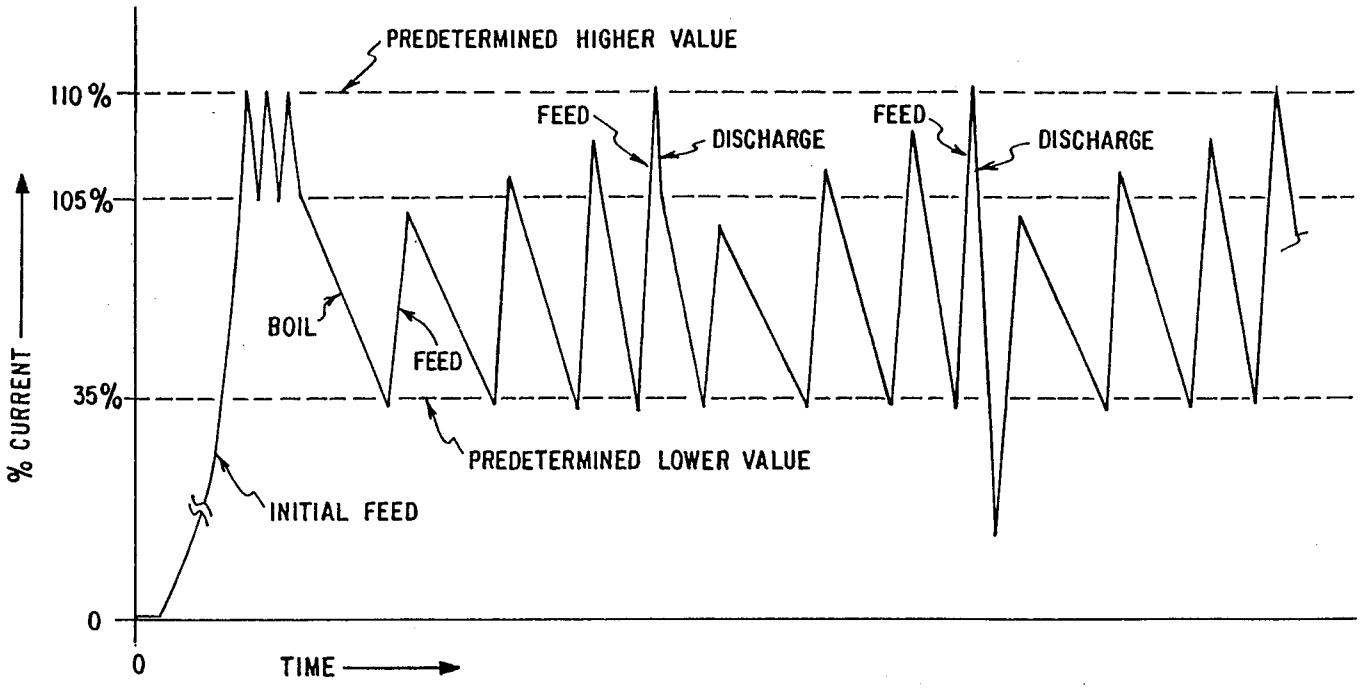

An example of control means in accordance with the invention as applied to a multi-electrode boiler humidifier is illustrated in the accompanying drawings, in which:

FIG. 1 is a diagrammatic representation of a multi-electrode boiler and its control means; and FIG. 2 is a graph illustrating operation of the boiler.

FIG. 1 shows a humidifier boiler 10 for use at or near ambient atmospheric pressure for the humidification of air. The boiler has two or more electrodes 12 connected to an electrical supply source 14 so that current flowing between them through the water in the boiler heats the water to boiling point. The boiler has a steam outlet 16 as well as means 18 in the form of a feed valve for feeding water into the boiler, means 20 in the form of a pump for discharging water from the boiler (although these means could equally well be a valve adapted to drain under gravity), means 22 for sensing the current in one or more electrodes, and control means 24 responsive to the sensed electrode current arranged to initiate the feed means 18 when the electrode current is below a predetermined lower value and to initiate the discharge means 20 when the electrode current has risen above a predetermined higher value. A level-sensing electrode 26 is provided in the upper part of the boiler to sense when the water level has reached a permissible upper limit. When the water level reaches this electrode, operation of the feed means is inhibited and an external signal may be initiated to indicate that the boiler electrodes are fully scaled.

The operation of the boiler will now be described in detail.

Commencing with a new boiler cylinder, empty, and connected to a water supply of average conductivity (300–800 micro-siemens), the following will be the expected sequence of events.

On connecting the electrical supply and switching on, the feed valve 18 will open and water will enter the cylinder. When the water level reaches the bottom of the electrodes 12, electrode current will start to flow. The water level will then rise up the electrodes and the electrode current will increase approximately linearly with immersed height. As the water level rises, the increasing electrode current will heat the water causing the conductivity to increase. This effect will cause the electrode current to rise more rapidly than a true linear relationship with immersed height. When the water level has reached a height which could be almost to the top of the electrodes, according to the conductivity of the supply water, the current will have reached 95% of the operating set value and the close differential comparator set to operate at this level will switch or flip. This action will initiate the commencement of the feed valve timing period, and the feed valve will continue to be held open until the end of this timing period (typically ten seconds) at which point the feed valve will close. As the feed water has been passing through a flow controller regulating the flow to a fixed flow rate, during this time period a fixed additional volume of water will have entered the boiler. This additional volume of water will cause a further increase in electrode current above the 95% level at which the switching operation took place. At this point in the sequence of operations, this increase in current will probably be about 5%, causing the electrode current to rise to, say, 100% of the nominal set value.

At this point, the water temperature has probably reached about 60° C., and the temperature and hence the conductivity will continue to rise, with the feed valve remaining closed. As the water conductivity will then be rising with a fixed water level, the electrode current will rise fairly rapidly. When it has risen to, say, 110% of the nominal set value, the discharge device 20 will be initiated and will remain operative until enough water has been discharged from the boiler, such that the current falls to approximately 105% or, alternatively, for a predetermined time period. Due to the temperature rising further, the current may again rise to 110% repeating a discharge operation. This process may, in fact, take place several times.

When the water temperature has reached 100° C. and the water boils, the water level will be lower in the boiler with probably half of the electrodes immersed. The water will then continue to boil with consequent lowering of the electrode current and lowering of the water level as the conductivity of the water in the boiler progressively increases. When the electrode current has again fallen to just below 95%, the comparator set at this level will switch or flip and open the feed valve. This will cause water to enter the boiler, the water level to rise and consequently the current to rise. After a very small increase in electrode current to, say, 95% the comparator will switch or flip back and initiate the feed valve timing period once again. The same fixed volume of water will now enter the cylinder during this timing period after which the feed valve will close. However, as the immersed electrode height is now only approximately half of that experienced on the initial start-up, this increase in water level will represent a greater proportion of the immersed electrode height. As a result of this the electrode current increase will be greater, probably about 10%, thereby increasing the electrode current from 95%, the level at which the comparator switched or flipped, up to 105%.

This sequential process of boiling and feeding will continue automatically, However, as no water is being discharged from the boiler other than that evaporated away as steam, the mineral content of the water will progressively build up and, therefore, the conductivity of the water in the boiler will progressively increase. As the conductivity increases, the immersed height of electrode representing the 95% current threshold will progressively reduce.

Simultaneously, the increase in electrode current caused by the introduction of the fixed volume of feed water will progressively increase.

After a certain period of operation, this increase in current caused by the fixed volume of feed water will become as high as 15%, causing the electrode current to increase from the threshold point of 95% up to 110%. When this occurs, the discharge means will be initiated and will continue to operate until either the electrode current has fallen to 105%, or alternatively until the end of the predetermined time period determined by the control means. The "concentrated" water discharged from the boiler, subsequently replaced by fresh feed water, will cause a reduction in the conductivity of the water in the boiler.

If this reduction is not sufficient to bring the system into equilibrium and allow it to continue to operate with substantially constant conductivity of the water in the boiler, the following events will occur.

If the conductivity in the boiler continues to rise, the increase in current caused by the introduction of the fixed quantity of water will also continue to rise. For example, this rise could be as much as 40% of the nominal current. In this event the rise of 15%, which is sufficient to initiate the discharge device, will have taken place approximately $\frac{3}{8}$th through the feed valve timing period at which point the discharge means will be initiated. The current will then not continue to rise above 110%, as the rate of water discharge will far exceed the rate of water feed. The result will be the removal of a considerable volume of concentrated water from the boiler, thereby effecting a considerable reduction in the water conductivity in the boiler.

It will be seen that the greater the conductivity of the water in the boiler, the earlier in the feed valve timing period will occur the point at which the discharge means are initiated and the greater will be the purification effect. This will effectively create a proportional control which, notwithstanding a wide range of feed water conductivities, will always be able to stabilize at an equilibrium condition.

The boiler humidifier described above can be sold commercially in two ranges to meet the needs of current demand. One range can be as simple and low cost as possible, having outputs of two, four, eight, fifteen, thirty and sixty kilograms per hour in a single stage on/off control. The other range can be one of high sophistication suitable for modulated output from 10% to 100% and based essentially on the principle described in EP-A-02 45 023. In this case outputs can be four, eight, fifteen, thirty and sixty kilograms per hour. It is unlikely that a smaller version would be wanted but, if it was, then the four could be used at a reduced output.

The boilers should, preferably, all be disposable and not cleanable. In order to minimize the cost of replacement boilers, they should be constructed in as simple a manner as possible. As boilers with barriers between the electrodes need not be used, the other parameters of the system can be designed in such a way that optimum performance can be achieved with a simple non-barrier arrangement.

The boilers should not operate full of water as in the system described in GB-B-1,418,994 but should utilize at any time only a small Vertical effective height of the electrodes, with the water level rising up in the boiler as the electrodes become scaled. In this way, optimum current density can be achieved at the electrode surface, thereby maximizing the self-cleaning effect of the relatively high current density but at the same time minimizing the maximum value of this current density such that erosion of the electrode itself does not occur. The electrodes can be supported by stainless steel rods with the best results being achieved by using thin stainless steel sheet for the electrodes themselves. If this is done, a lot of the scale will flake off in thin slivers, probably less than 1 mm thick. This needs to be borne in mind when designing the strainer at the discharge outlet so that the strainer comprises slots of relatively limited length (say 5–8 mm) to avoid the possibility of these slivers passing through or becoming lodged and thereby blocking the strainer.

I claim:

1. An electrode water boiler, preferably for the humidification of air, comprising a boiler, at least two electrodes in the boiler adapted to be connected to an electrical supply and between which current flows through the water during operation of the boiler in order to heat the water and generate steam, a steam outlet from the boiler, water feed means connected to the boiler for feeding water into the boiler, water discharge means leading from the boiler for discharging water therefrom, electrode current sensing means for sensing the current in at least one of the electrodes, and boiler water control means connected to the electrode current sensing means in order to control the supply of water to and the discharge of water from the boiler in response to changes in the electrode current sensed by the electrode current sensing means, in which the boiler water control means are constructed and arranged to:

(a) initiate the water feed means to supply water to the boiler when the electrode current sensed by the electrode current sensing means is below a predetermined lower value;

(b) initiate the water discharge means to discharge water from the boiler after the electrode current sensed by the electrode current sensing means has risen above a predetermined higher value; and (c) again initiate the water feed means, following the above initial initiation of the feed water means, when the electrode current sensed by the electrode current sensing means subsequently rises to a predetermined intermediate value between the said lower value and the said higher value to effect the introduction, into the boiler, of a fixed measured quantity of feed water.

2. An electrode water boiler according to claim 1, in which, following initiation of the water discharge means, the boiler water control means are arranged to keep the water discharge means activated until the electrode current has fallen to a predetermined value lower than the said higher value.

3. An electrode water boiler according to claim 1, in which, following initiation of the water discharge means, the boiler water control means are arranged to ensure that the water discharge means remain activated for a predetermined period of time.

4. An electrode water boiler according to claim 1, in which, if the water discharge means are initiated during a water feed period, the heater water control means are arranged to keep the water discharge means activated until the end of the water feed period.

5. An electrode boiler according to claim 4, in which the boiler water control means are arranged to keep the water discharge means activated for a further period of time following the completion of the introduction into the boiler of the fixed quantity of feed water.

6. An electrode boiler according to claim 5, in which the boiler water control means are arranged to ensure that the length of the additional period of activation of the water discharge means is a function of the point during the feed period at which the water discharge means was initiated.

7. An electrode water boiler according to claim 5, in which the boiler water control means are arranged to additionally activate the water feed means during the additional activation period of the water discharge means.

8. An electrode water boiler according to claim 1, in which a container of predetermined volume is provided for the introduction of the fixed measured quantity of feed water into the boiler.

9. An electrode water boiler according to claim 1, in which the boiler water control means are arranged to effect the introduction of the fixed measured quantity of feed water into the boiler by passing the feed water through a constant flow rate device for a predetermined period of time.

10. An electrode water boiler according to claim 1, in which the boiler water control means are arranged to disconnect the electrical supply to the electrodes during the period(s) when the water discharge means are activated.

11. An electrode water boiler according to claim 1, in which means are provided for varying the steam output of the boiler by varying the pulse width modulation of the power supplied to the electrodes.

* * * * *